US009546507B2

(12) United States Patent
Letson

(10) Patent No.: US 9,546,507 B2
(45) Date of Patent: Jan. 17, 2017

(54) SAFETY BOLT DEVICE AND SYSTEM

(71) Applicant: William K. Letson, Lisbon, CT (US)

(72) Inventor: William K. Letson, Lisbon, CT (US)

( * ) Notice: Subject to any disclaimer, the term of this patent is extended or adjusted under 35 U.S.C. 154(b) by 208 days.

(21) Appl. No.: 14/484,334

(22) Filed: Sep. 12, 2014

(65) Prior Publication Data

US 2015/0130196 A1 May 14, 2015

Related U.S. Application Data

(60) Provisional application No. 61/960,479, filed on Sep. 16, 2013.

(51) Int. Cl.

| | |
|---|---|
| ***E05C 19/18*** | (2006.01) |
| ***E05C 21/00*** | (2006.01) |
| *E05C 19/00* | (2006.01) |
| *E05C 17/04* | (2006.01) |
| *E05C 17/00* | (2006.01) |
| *E05B 65/08* | (2006.01) |

(52) U.S. Cl.

CPC ..... *E05C 19/184* (2013.01); *E05C 17/047* (2013.01); *E05C 21/00* (2013.01); *E05B 65/0894* (2013.01); *E05C 17/00* (2013.01); *E05C 17/04* (2013.01); *E05C 19/18* (2013.01); *E05C 19/182* (2013.01); *Y10T 292/379* (2015.04)

(58) Field of Classification Search

CPC ..... Y10S 292/15; Y10S 292/17; E05C 19/18; E05C 19/182; E05C 19/184; E05C 17/00; E05C 17/04; E05C 17/024; E05C 17/047; E05B 65/0894

USPC ..... 292/262, 281, 283, 288, 289, 292–295,292/340, 342; 16/82; 49/394

See application file for complete search history.

(56) References Cited

U.S. PATENT DOCUMENTS

| | | | | | |
|---|---|---|---|---|---|
| 210,242 | A | * | 11/1878 | Cooke | E05B 65/0864 292/145 |
| 720,496 | A | * | 2/1903 | Simpson | E05B 15/0053 292/156 |
| 853,507 | A | * | 5/1907 | Fielding | E05D 11/1078 16/329 |
| 896,495 | A | * | 8/1908 | Wentz | E05B 65/0864 292/175 |
| 1,435,182 | A | * | 11/1922 | Shaw | B60J 7/1851 248/182.1 |

(Continued)

FOREIGN PATENT DOCUMENTS

| | | | | | |
|---|---|---|---|---|---|
| FR | 2678979 | A1 | * | 1/1993 | E05C 17/047 |
| FR | 2729705 | A1 | * | 7/1996 | E05C 19/184 |

(Continued)

*Primary Examiner* — Carlos Lugo

(74) *Attorney, Agent, or Firm* — Michael A. Blake

(57) ABSTRACT

A safety bolt device comprising: a drop down bolt, the drop down bolt comprising: a cross-member; a first vertical pin attached to a first end of the cross-member; a second vertical pin attached to a second end of the cross-member; a door receiver configured to receive the first vertical pin, the door receiver comprising: a bolt; a jamb receiver configured to receive the second vertical pin, the jamb receiver comprising: a pin; where the door receiver is configured to attach to a door, and the jamb receiver is configured to attach to the door jamb of the door, and where the safety bolt device is configured to prevent the door from being opened when the drop down bolt has been dropped into the door receiver and the jamb receiver.

7 Claims, 5 Drawing Sheets

(56) References Cited

U.S. PATENT DOCUMENTS 1,464,345 A * 8/1923 Tomford ..... E05F 11/00 292/262
1,483,316 A * 2/1924 Seelinger ..... E05C 17/203 16/82
1,505,796 A * 8/1924 Norris ..... H01M 2/1005 16/444
1,571,024 A * 1/1926 Scheid ..... E05B 65/0864 292/156
3,206,793 A * 9/1965 Silverberg ..... E05C 19/003 16/223
3,583,738 A 6/1971 Uphoff
3,961,816 A * 6/1976 Mueller ..... E05C 19/18 292/148
4,262,503 A * 4/1981 Kuebler ..... E05C 19/003 292/259 R
4,268,074 A * 5/1981 Alexander ..... E05B 65/0864 292/149
4,286,810 A * 9/1981 Ehmen ..... E05C 17/50 292/175
4,300,793 A * 11/1981 Benzel, Jr. ..... E05B 67/383 292/205
4,453,751 A * 6/1984 Hamilton ..... E05B 15/0205 292/340
4,474,394 A * 10/1984 Crepinsek ..... E05B 15/0205 292/340
4,569,545 A * 2/1986 Hartmann ..... E05C 19/08 292/281
4,605,251 A 8/1986 Finlay
4,832,386 A * 5/1989 Sweet ..... E05B 15/0205 292/264
5,031,946 A * 7/1991 Yarrow ..... E05B 15/1614 292/337
5,237,724 A * 8/1993 Lee ..... E05C 17/025 16/375
5,273,326 A * 12/1993 Kinkaide ..... E05C 17/04 292/272
5,274,881 A 1/1994 DeRosa
5,340,172 A 8/1994 Sweet
5,398,982 A 3/1995 Watson, Jr.
5,556,143 A 9/1996 Robinson
6,345,849 B1 * 2/2002 Yen ..... E05C 17/54 292/292
6,746,092 B2 * 6/2004 Leccia ..... H02B 1/38 292/300
7,000,290 B1 * 2/2006 Ace ..... E05D 5/10 16/229
8,272,625 B1 9/2012 Bassett
8,690,201 B2 * 4/2014 Frazier ..... E05B 65/0007 256/1
2006/0043739 A1 * 3/2006 Gogel ..... E05B 17/2023 292/148
2006/0279093 A1 12/2006 Tang

FOREIGN PATENT DOCUMENTS

GB 812585 A * 4/1959 ..... E05C 19/184
GB 2253005 A * 8/1992 ..... E05B 67/383

* cited by examiner

SAFETY BOLT DEVICE AND SYSTEM

CROSS-REFERENCES

This patent application claims the benefit of provisional patent application Ser. No. 61/960,479, by William Keith Letson and Anne Letson, entitled "Drop locked-used to secure door with a simple drop in bar method", filed on Sep. 16, 2013, and which provisional application is fully incorporated by reference herein.

TECHNICAL FIELD

The present invention relates to a safety bolt device and system, and more specifically to a safety bolt device and system for quickly immobilizing a door to prevent an intruder attack.

BACKGROUND

There have been many instances of school and/or workplace violence. If an assailant has or obtains keys to a school or workplace, then locking the door will not protect the occupants in a room. Even if the door is locked, and the assailant does not have a key, many times an assailant can kick or otherwise knock down a door that is merely held in place by a standard door lock.

Thus there is a need for a device and system that can overcome the above and other disadvantages.

SUMMARY OF THE INVENTION

The invention relates to a safety bolt device comprising: a drop down bolt, the drop down bolt comprising: a cross-member; a first vertical pin attached to a first end of the cross-member; a second vertical pin attached to a second end of the cross-member, the second vertical pin parallel to the first vertical pin, and a fixed distance from the first vertical pin; a door receiver configured to receive the first vertical pin, the door receiver comprising: a bolt; a bolt vertical pin hole located on the bolt, the bolt vertical pin hole being a through hole, and the bolt vertical pin hole oriented generally perpendicular to the length of the bolt, and the bolt vertical pin hole configured to accept the first vertical pin; a jamb receiver configured to receive the second vertical pin, the jamb receiver comprising: a pin; a pin vertical pin hole located on the pin, the pin vertical pin hole being a through hole, and the pin vertical pin hole oriented generally perpendicular to the length of the pin, and the pin vertical pin hole configured to accept the second vertical pin; where the door receiver is configured to attach to a door, and the jamb receiver is configured to attach to the door jamb of the door, and where the safety bolt device is configured to prevent the door from being opened when the drop down bolt has been dropped into the door receiver and the jamb receiver.

The invention also relates to a safety bolt kit comprising: a kit housing, the housing comprising a base, and a hinged cover; a safety bolt device located in the kit housing, the safety bolt device comprising: a drop down bolt, the drop down bolt comprising: a cross-member; a first vertical pin attached to a first end of the cross-member; a second vertical pin attached to a second end of the cross-member, the second vertical pin parallel to the first vertical pin, and a fixed distance from the first vertical pin; a door receiver configured to receive the first vertical pin, the door receiver comprising: a bolt; a bolt vertical pin hole located on the bolt, the bolt vertical pin hole being a through hole, and the bolt vertical pin hole oriented generally perpendicular to the length of the bolt, and the bolt vertical pin hole configured to accept the first vertical pin; a jamb receiver configured to receive the second vertical pin, the jamb receiver comprising: a pin; a pin vertical pin hole located on the pin, the pin vertical pin hole being a through hole, and the pin vertical pin hole oriented generally perpendicular to the length of the pin, and the pin vertical pin hole configured to accept the second vertical pin; where the door receiver is configured to attach to a door, and the jamb receiver is configured to attach to the door jamb of the door, and where the safety bolt device is configured to prevent the door from being opened when the drop down bolt has been dropped into the door receiver and the jamb receiver.

In addition, the invention relates to a safety bolt system comprising: a door rotatably attached to a door jamb; a door receiver attached to the door, the door receiver comprising: a door receiver housing, the door receiver housing comprising: a door receiver entry hole located on a top surface of the door receiver housing; a door receiver exit hole located on a bottom surface of the door receiver housing; a bolt; a bolt vertical pin hole located on the bolt, the bolt vertical pin hole being a through hole, and the bolt vertical pin hole oriented generally perpendicular to the length of the bolt, a bolt hole located on a door receiver rear surface of the door receiver housing, where the bolt is configured to slide into the bolt hole; threads located on a distil end of the bolt; a door receiver housing drift pin hole located in one side of the door receiver housing; a bolt drift pin hole located in the bolt, generally perpendicular to the bolt vertical pin hole and offset from the bolt vertical pin hole; a door receiver drift pin configured to slide into the door receiver housing drift pin hole and the bolt drift pin hole thereby locking the bolt with respect to the door receiver housing; a nut configured to mate with the threads, such that the nut and the distil end of the bolt are on one side of the door, and the door receiver is attached to the opposite side of the door; a jamb receiver attached to the doorjamb, the jamb receiver comprising: a jamb receiver entry hole located on a top surface of the jamb receiver housing; a jamb receiver exit hole located on a bottom surface of the jamb receiver housing; a pin; a pin vertical pin hole located on the pin, the pin vertical pin hole being a through hole, and the pin vertical pin hole oriented generally perpendicular to the length of the pin, a; a pin hole located on a rear surface of the jamb receiver housing, where the pin is configured to slide into the pin hole; a jamb receiver housing drift pin hole located in one side of the jamb receiver housing; a pin drift pin hole located in the pin, generally perpendicular to the pin vertical pin hole and offset from the pin vertical pin hole; a pin drift pin configured to slide into the jamb receiver housing drift pin hole and the pin drift pin hole thereby locking the pin with respect to the jamb receiver housing; a drop down bolt configured to slide into the door receiver and the jamb receiver, the drop down bolt comprising: a cross-member; a first vertical pin attached to a first end of the cross-member; a second vertical pin attached to a second end of the cross-member, the second vertical pin parallel to the first vertical pin, and a fixed distance from the first vertical pin; where the first pin is configured to slide into the door receiver entry hole, through the bolt via the door receiver vertical pin hole, and out the door receiver exit hole; and where the second pin is configured to slide into the jamb receiver entry hole, through the pin via the pin vertical pin hole, and out the jamb receiver exit hole.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
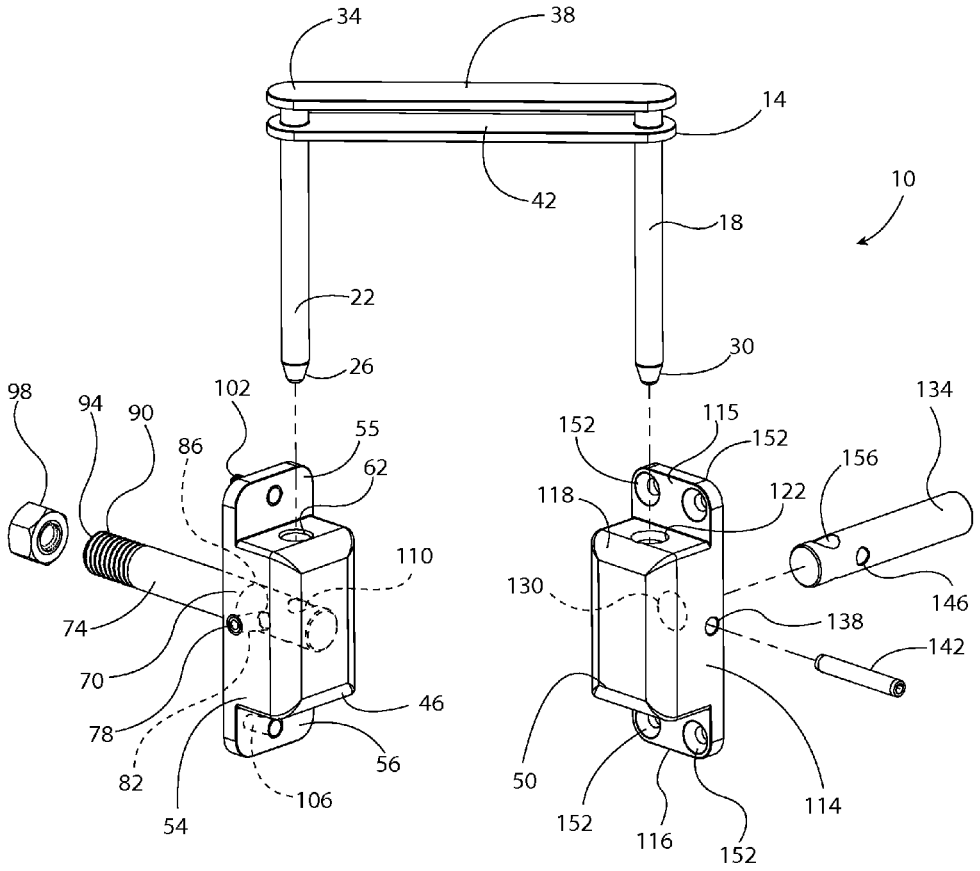
FIG. 1 is a front perspective view of the safety bolt device.

FIG. 1 is a generally exploded view of the disclosed safety bolt device 10. The device 10 comprises a drop down bolt 14. The drop down bolt 14 comprises two vertical pins 18, 22. The distil ends 26, 30 of the two vertical pins 18, 22, respectively may be tapered. The vertical pins 18, 22 are attached to one another via a cross-member 34. In one embodiment, the cross-member 34 may comprise two horizontal members 38, 42 rigidly attached to the pins 18, 22. The two horizontal members 38, 42 provide greater strength to the drop down bolt 14. The bolt 14 is configured to drop down into two receivers, a door receiver 46, and a jamb receiver 50.

The door receiver comprises a housing 54. The housing 54 comprises vertical pin housing 58. The vertical pin housing 58 comprises an entry hole 62 and an exit hole 66 (the exit hole 66 is not visible in this view due to it being located on the underside of the vertical pin housing 58). The entry hole 62 is configured to receive the pin 22, and the exit hole 66 is configured to allow the pin 18 to extend through and exit the hole 66. The housing 54 comprises bolt hole 70. The bolt hole is configured to allow a bolt 74 to slide into the bolt hole 70 and into the housing 54. The housing 54 also comprises a drift pin housing hole 78, and a drift pin 82. The drift pin 82 is configured to hold the bolt 74 in the housing 54, when the drift pin 82 has mated with a drift pin bolt hole 86 located on the bolt 74. The bolt 74 may have threads 90 located on its distil end 94. A nut 98 may be attachable to the bolt 74 via the threads 90. The housing may also comprise an upper flange 55 and a lower flange 56. The upper flange 55 may comprise a first door pin 102 and the lower flange 56 may comprise a second door pin 106. The door pins 102, 106 are configured to mate with holes drilled into a door, to keep the housing 54 from rotating with respect to the door. The bolt 74 comprises a vertical pin hole 110. The vertical pin hole 110 is configured to allow the pin 22 to go through the bolt 74.

The jamb receiver 50 comprises a housing 114. The housing 114 comprises vertical pin housing 118. The vertical pin housing 118 comprises an entry hole 122 and an exit hole 126 (the exit hole 126 is not visible in this view due to it being located on the underside of the vertical pin housing 118). The entry hole 122 is configured to receive the pin 18, and the exit hole 126 is configured to allow the pin 18 to extend through and exit the hole 126. The housing 114 comprises pin hole 130. The pin hole 130 is configured to allow a pin 134 to slide into the pin hole 130 and into the housing 114. The pin 134 may be a shear pin. The housing 114 also comprises a drift pin housing hole 138, and a drift pin 142. The drift pin 142 is configured to hold the pin 134 in the housing 114, when the drift pin 142 has mated with a drift pin hole 146 located on the pin 134. The housing 114 may also comprise an upper flange 115 and a lower flange 116. The upper flange 115 may have one or more screw holes 152. The lower flange 116 may comprise one more screw holes 152 also. The screw holes 152 are configured to allow screws to attach the jamb receiver to a door jamb via the screw holes 152. The pin 134 comprises a vertical pin hole 156. The vertical pin hole 156 is configured to allow the pin 18 to go through the pin 134.

Figure 2:
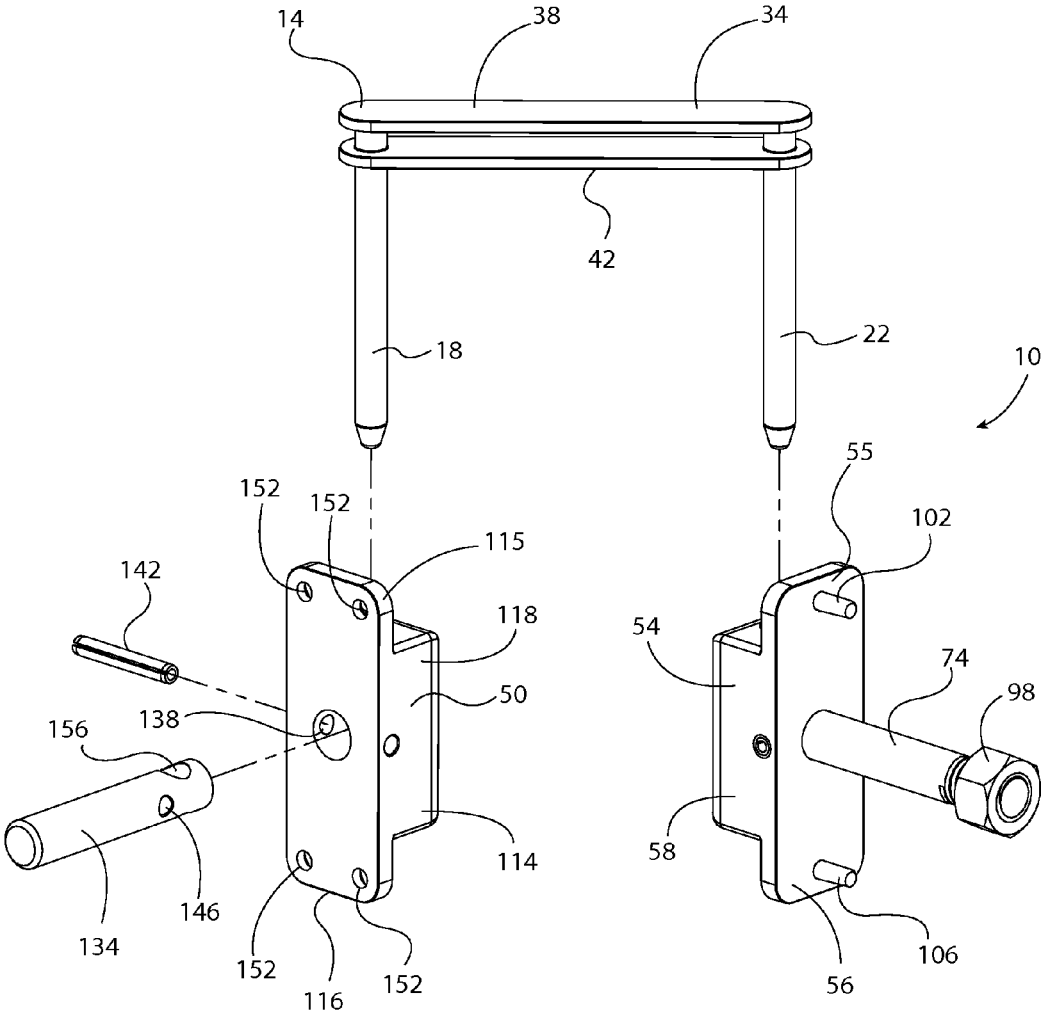
FIG. 2 is a rear perspective view of the safety bolt device.

FIG. 2 is a rear view of the safety bolt device 10 from FIG. 1.

Figure 3:
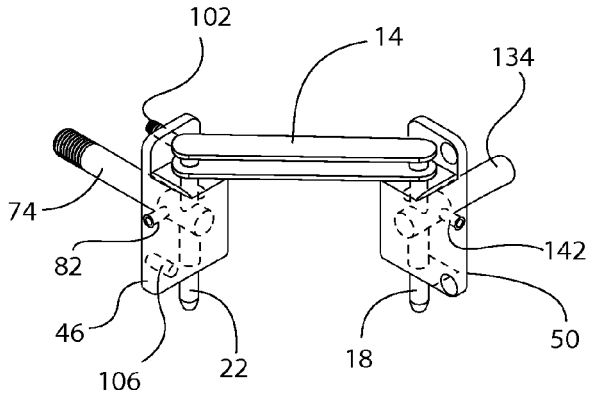
FIG. 3 is a front perspective view of the safety bolt device with the drop down bolt inserted into the receivers.
Figure 4:
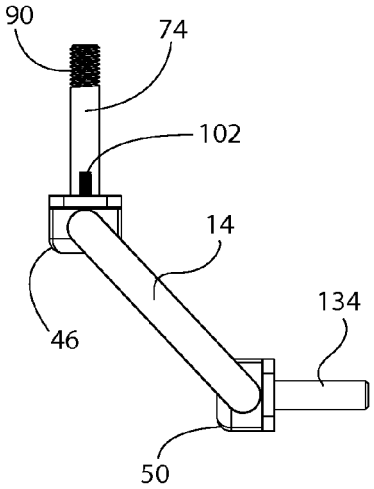
FIG. 4 is a top view of the safety bolt device from FIG. 3.
Figure 5:
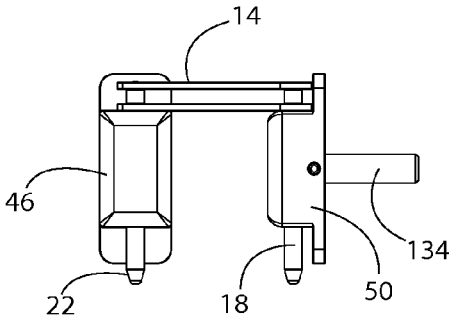
FIG. 5 is a side view of the safety bolt device from FIG. 3.
Figure 6:
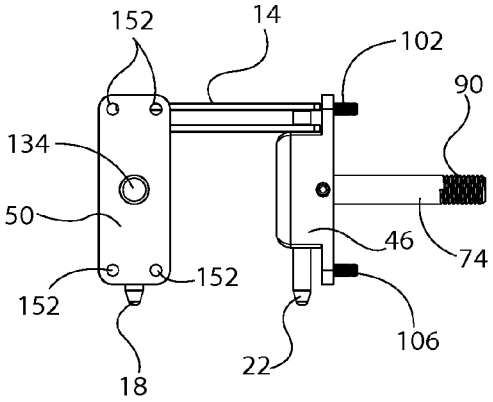
FIG. 6 is another side view of the safety bolt device from FIG. 3.

FIG. 3 is a perspective view of the safety bolt device 10 with the drop down bolt 14 inserted into the door receiver 46 and the jamb receiver 50. FIG. 4 is a top view of the safety bold device 10 from FIG. 3. FIG. 5 is a side view of the safety bolt device 10, looking at a side view of the jamb receiver 50 and looking at the front of the door receiver 46, from FIG. 3. FIG. 6 is a side view of the safety bolt device 10, looking at a side view of the door receiver 46, and a rear view of the jamb receiver 50, from FIG. 3.

Figure 7:
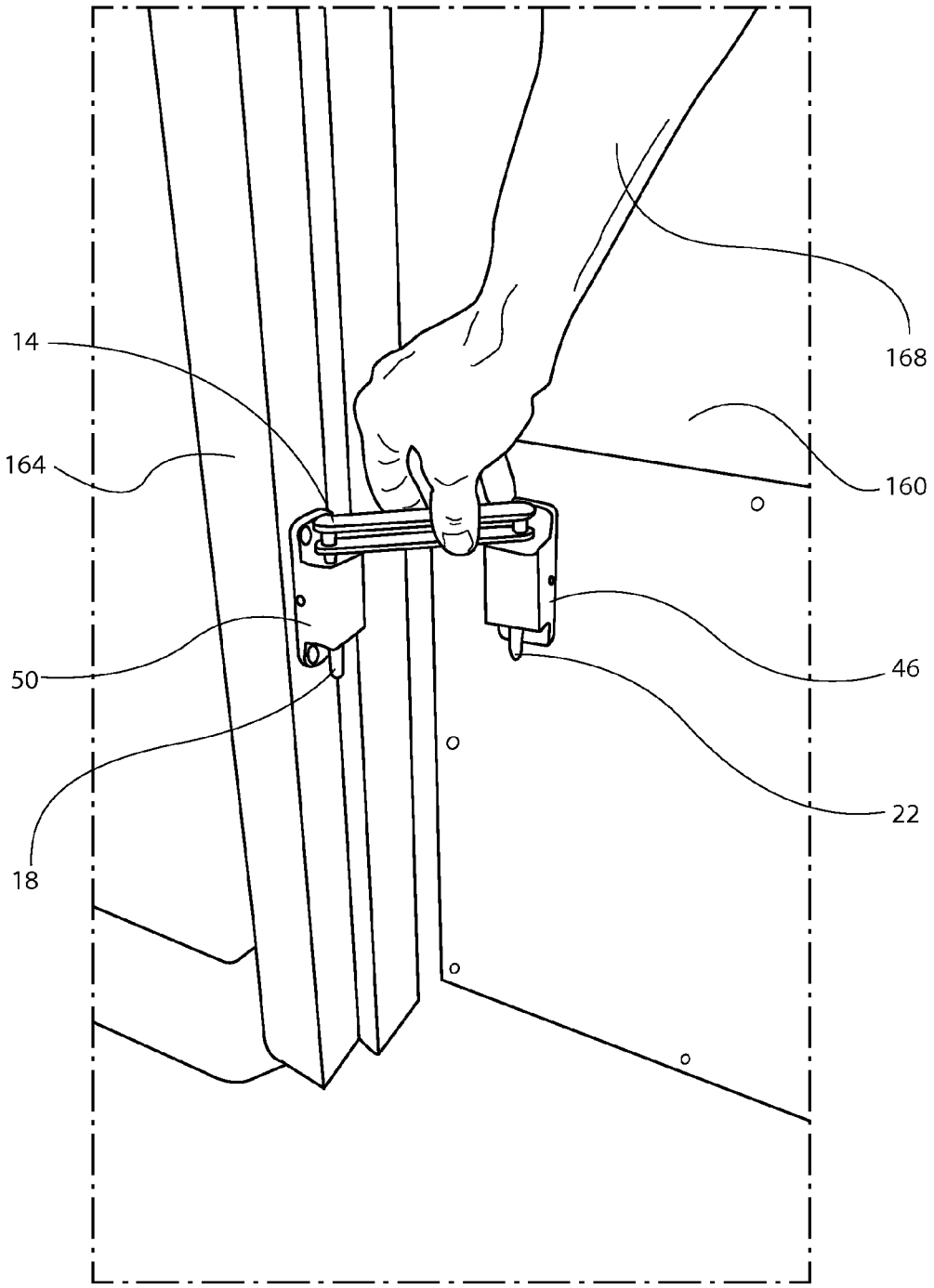
FIG. 7 is a front view of the safety bolt device installed on a door and a door jamb.

FIG. 7 shows the device 10 installed on a door 160 and a door jamb 164. A user 168 is shown dropping the drop down bolt 14 into the receivers 46, 50.

One method of installing the safety bolt device 10 is to line up the door receiver 46 and jamb receiver on a door and door jamb respectively so that the drop down bolt 14 can easily drop down into both receivers 46, 50. Mark the spots where the receivers go, and drill the proper holes. For the door receiver 46, a door hole that goes through a door should be drilled for the bolt 74. Two holes will be drilled in the door for the door pins 102 and 106 to slide into. The bolt 74 will go through the door hole, and the nut 98 will be screwed onto the threads 90 of the bolt, on the door side opposite of where the door receiver 46 will be located. On the door jamb, a large hole will be drilled for the pin 134. This hole will not generally be a through hole. A through hole is a hole that goes all the way through the door jamb and comes out the other side where it would be visible to the user. Four pilot holes may be drilled for the screws to attach the jamb receiver 50 to the jamb via the screw holes 152. In one embodiment, the nut 98 may be a security nut, which requires a special tool to unscrew.

Figure 8:
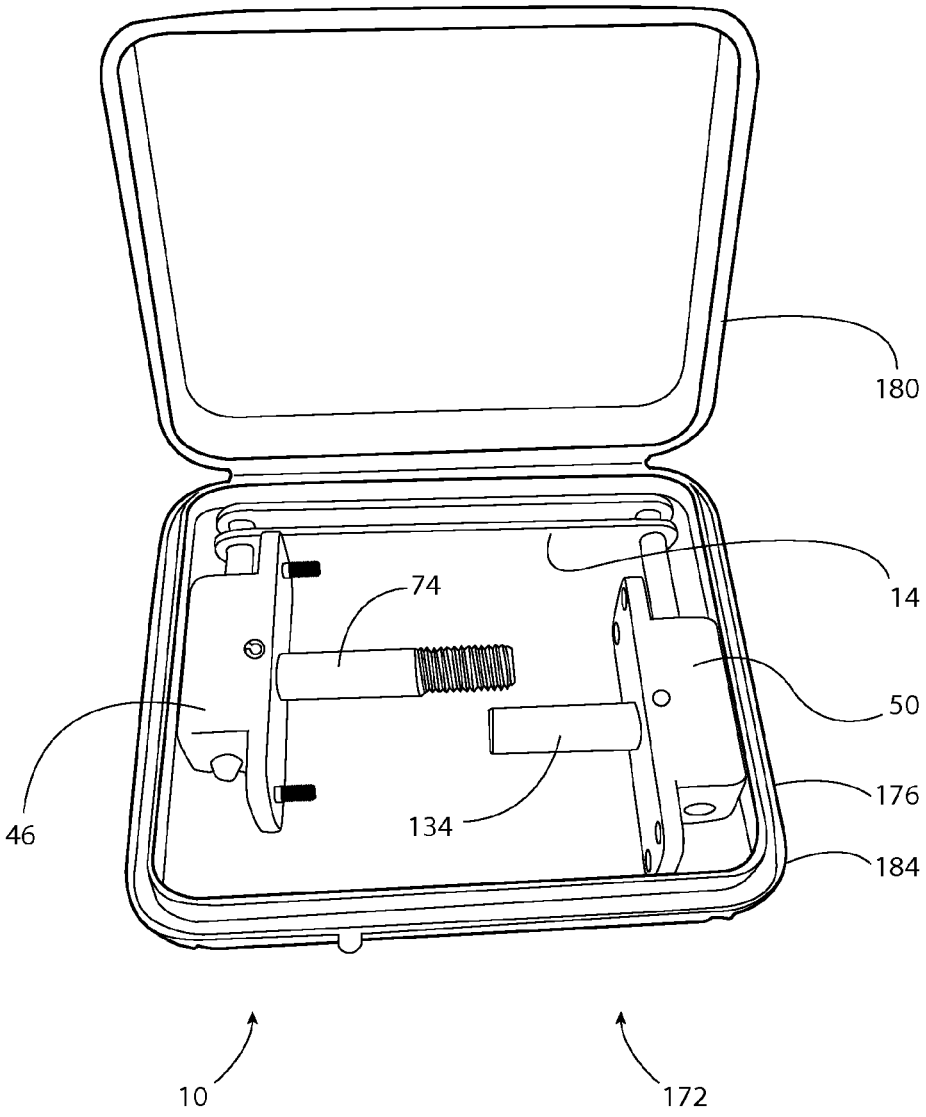
FIG. 8 is a front view of the safety bolt kit.

FIG. 8 shows a kit 172 used for storing, and using the safety bolt device 10. The kit 172 may comprise a housing 176 that contains a cover 180 and a base 184. The cover 176 may be attached to the base 184 via a hinged lid design. The kit may also have a packing material 188 in the base 184 and/or cover 180. The packing material 188 may be any suitable material including, but not limited to: Styrofoam, foam rubber, etc. The packing material 188 may have cut outs configured to hold the various components that make up the safety bolt device 10. In one embodiment, when the receivers 46, 50 are installed on the door and jamb respectively, the housing may be attached to a nearby wall in the room via any suitable attachment means, including screwing the base 184 to a wall with screws. The drop down bolt 14 may be stored in the housing 176 on the wall. During an emergency situation, a user simply goes to the housing on the wall, opens the cover, pulls out the drop down bolt 14, and slides the bolt 14 into the receivers 46, 50, thereby preventing the door from being opened.

The disclosed invention has many advantages. When installed, it provides an easy means to lock a door simply by dropping the drop down bolt into the door and jamb receivers. The entry holes 62, 122 are small enough to generally prevent small fingers from fitting in the holes 62, 122. The disclosed invention may be positioned so that it is very difficult to reach. The shear pin 134 is installed in the door jamb to add a considerable amount of strength and resistance to prevent failure. The entry holes 62, 122 may be tapered to guide the drop down bolt 14 easily into the receivers 46, 50. The drop down bolt 14 may be tapered at the distil ends 26, 30 to allow for easy entry into the entry holes 62, 122. The invention is generally designed to be installed on just about any style of door jam. Having two separate receivers 46, 50 provides the ability of the invention to fit onto many door styles and jam sizes. The invention is very simple to deploy. The invention can generally work with swing in or swing outdoors. The invention is relatively inexpensive. The drop down bolt may be stored in a secure location and configured to only be used in an emergency situation. If the drop down bolt is deployed and needs to be undone, there may also be a security tool that allows a user to release the door receiver.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A safety bolt device comprising:

a drop down bolt, the drop down bolt comprising:

a cross-member;

a first vertical pin attached to a first end of the cross-member;

a second vertical pin attached to a second end of the cross-member, the second vertical pin parallel to the first vertical pin, and a fixed distance from the first vertical pin;

a door receiver configured to receive the first vertical pin, the door receiver comprising:

a bolt;

a bolt vertical pin hole located on the bolt, the bolt vertical pin hole being a through hole, and the bolt vertical pin hole oriented generally perpendicular to the length of the bolt, and the bolt vertical pin hole configured to accept the first vertical pin;

a jamb receiver configured to receive the second vertical pin, the jamb receiver comprising:

a pin;

a pin vertical pin hole located on the pin, the pin vertical pin hole being a through hole, and the pin vertical pin hole oriented generally perpendicular to the length of the pin, and the pin vertical pin hole configured to accept the second vertical pin;

wherein the door receiver is configured to attach to a door, and the jamb receiver is configured to attach to the door jamb of the door, and wherein the safety bolt device is configured to prevent the door from being opened when the drop down bolt has been dropped into the door receiver and the jamb receiver;

the door receiver further comprising:

a door receiver housing;

a door receiver entry hole located on a top surface of the door receiver housing;

a door receiver exit hole located on a bottom surface of the receiver housing;

a bolt hole located on a door receiver rear surface of the door receiver housing, wherein the bolt is configured to slide into the bolt hole;

threads located on s distil end of the bolt;

a door receiver housing drift pin hole located in one side of the door receiver housing;

a bolt drift pin hole located in the bolt, generally perpendicular to the bolt vertical pin hole and offset from the bolt vertical pin hole;

a door receiver drift pin configured to slide into the door receiver housing drift pin hole and the bolt drift pin hole thereby locking the bolt with respect to the door receiver housing;

wherein the first pin is configured to slide into the door receiver entry hole, through the bolt via the door receiver vertical pin hole, and out the door receiver exit hole;

a nut configured to mate with the threads, such that the nut and the distil end of the bolt are on one side of a door, and the door receiver is attached to the opposite side of the door;

the jamb receiver further comprising:

a jamb receiver housing;

a jamb receiver entry hole located on a surface of the jamb receiver housing;

a jamb receiver exit hole located on a bottom surface of the jamb receiver housing;

a pin hole located on a rear surface of the jamb receiver housing, wherein the pin is configured to slide into the pin hole;

a jamb receiver housing drift pin hole located in one side of the jamb receiver housing;

a pin drift pin hole located in the pin, generally perpendicular to the pin vertical pin hole and offset from the pin vertical pin hole;

a pin drift configured to slide into the jamb receiver housing drift pin hole and the pin drift pin hole thereby locking the pin with respect to the jamb receiver housing; and wherein the second pin is configured to slide into the jamb receiver entry hole, through the pin via the pin vertical pin hole, and out the jamb receiver exit hole.

2. The safety bolt device of claim 1, wherein:

the door receiver housing comprises:

an upper flange extending up from the door receiver housing and is generally parallel to the rear surface of the door receiver housing;

a lower flange extending down from the door receiver housing, is generally parallel to the rear surface of the door receiver housing, and is generally on an opposite side of the door receiver housing form the upper flange;

a first door pin extending from the upper flange in a direction generally orthogonal to the rear surface of the door receiver housing, the first door pin configured to slide into a hole located in the door;

a second door pin extending from the lower flange in a direction generally orthogonal to the rear surface of the door receiver housing, the second door pin configured to slide into a hole located in the door.

3. The safety bolt device of claim 1, wherein:

the jamb receiver housing comprises:

an upper flange extending up from the jamb receiver housing and is generally parallel to the rear surface of the jamb receiver housing;

a lower flange extending down from the jamb receiver housing, is generally parallel to the rear surface of the jamb receiver housing, and is generally on an opposite side of the jamb receiver housing form the upper flange;

a first screw hole located in the upper flange, the first screw hole configured to allow a screw to attach the jamb receiver housing to the door jamb;

a second screw hole located in the lower flange, the second screw hole configured to allow a screw to attach the jamb receiver housing to the door jamb.

4. The safety bolt device of claim 1, wherein the drop down bolt further comprises:

a second cross-member located adjacent and parallel to the first cross-member, the second cross-member attached to the first vertical pin and the second vertical pin.

5. The safety bolt device of claim 1, wherein the first vertical pin comprises a distil end that is tapered;

wherein the second vertical pin comprises a distil end that is tapered.

6. The safety bolt device of claim 1, where-in the pin is configured to sit in a hole located in the door jam.

7. A safety bolt system comprising:

a door rotatably attached to a doorjamb;

a door receiver attached to the door, the door receiver comprising:

a door receiver housing, the door receiver housing comprising:

a door receiver entry hole located on a top surface of the door receiver housing;

a door receiver exit hole located on a bottom surface of the door receiver housing;

a bolt;

a bolt vertical pin hole located on the bolt, the bolt vertical pin hole being a through hole, and the bolt vertical pin hole oriented generally perpendicular to the length of the bolt, a bolt hole located on a door receiver rear surface of the door receiver housing, wherein the bolt is configured to slide into the bolt hole;

threads located on a distil end of the bolt;

a door receiver housing drift pin hole located in one side of the door receiver housing;

a bolt drift pin hole located in the bolt, generally perpendicular to the bolt vertical pin hole and offset from the bolt vertical pin hole;

a door receiver drift pin configured to slide into the door receiver housing drift pin hole and the bolt drift pin hole thereby locking the bolt with respect to the door receiver housing;

a nut configured to mate with the threads, such that the nut and the distil end of the bolt are on one side of the door, and the door receiver is attached to the opposite side of the door;

a jamb receiver attached to the doorjamb, the jamb receiver comprising:

a jamb receiver entry hole located on a top surface of the jamb receiver housing;

a jamb receiver exit hole located on a bottom surface of the jamb receiver housing;

a pin;

a pin vertical pin hole located on the pin, the pin vertical pin hole being a through hole, and the pin vertical pin hole oriented generally perpendicular to the length of the pin, a;

a pin hole located on a rear surface of the jamb receiver housing, wherein the pin is configured to slide into the pin hole;

a jamb receiver housing drift pin hole located in one side of the jamb receiver housing;

a pin drift pin hole located in the pin, generally perpendicular to the pin vertical pin hole and offset from the pin vertical pin hole;

a pin drift pin configured to slide into the jamb receiver housing drift pin hole and the pin drift pin hole thereby locking the pin with respect to the jamb receiver housing;

a drop down bolt configured to slide into the door receiver and the jamb receiver, the drop down bolt comprising:

a cross-member;

a first vertical pin attached to a first end of the cross-member;

a second vertical pin attached to a second end of the cross-member, the second vertical pin parallel to the first vertical pin, and a fixed distance from the first vertical pin;

wherein the first pin is configured to slide into the door receiver entry hole, through the bolt via the door receiver vertical pin hole, and out the door receiver exit hole; and wherein the second pin is configured to slide into the jamb receiver entry hole, through the pin via the pin vertical pin hole, and out the jamb receiver exit hole.

* * * * *